US007843305B2

(12) United States Patent
Raman et al.

(10) Patent No.: US 7,843,305 B2
(45) Date of Patent: Nov. 30, 2010

(54) BOBBIN FOR SECONDARY WINDING OF IGNITION COIL

(75) Inventors: Umashankar Raman, Tamil Nadu (IN); Ashokkumar Karuppiah, Tamil Nadu (IN)

(73) Assignee: India Nippon Electricals Ltd. (IN)

( * ) Notice: Subject to any disclaimer, the term of this patent is extended or adjusted under 35 U.S.C. 154(b) by 0 days.

(21) Appl. No.: 12/298,297

(22) PCT Filed: Apr. 23, 2007

(86) PCT No.: PCT/IN2007/000156

§ 371 (c)(1),
(2), (4) Date: Dec. 24, 2008

(87) PCT Pub. No.: WO2007/122633

PCT Pub. Date: Nov. 1, 2007

(65) Prior Publication Data

US 2009/0219125 A1 Sep. 3, 2009

(30) Foreign Application Priority Data

Apr. 24, 2006 (IN) ..... 746/CHE/2006

(51) Int. Cl.
*H01F 27/30* (2006.01)

(52) U.S. Cl. ..... 336/208; 336/198

(58) Field of Classification Search ..... None
See application file for complete search history.

(56) References Cited

U.S. PATENT DOCUMENTS 1,589,177 A 6/1924 Kendall
3,742,312 A 6/1973 Hillyard
4,449,111 A * 5/1984 Nakajima ..... 336/206
4,639,706 A * 1/1987 Shimizu ..... 336/170
5,861,791 A * 1/1999 Schneider ..... 336/205
5,917,397 A * 6/1999 Sasahara ..... 336/206

FOREIGN PATENT DOCUMENTS

| | | |
|---|---|---|
| GB | 603721 | 6/1924 |
| GB | 585951 | 3/1947 |
| GB | 595083 | 11/1947 |
| GB | 936499 | 9/1963 |
| JP | 55061011 A * | 5/1980 |
| WO | WO 86/04118 A | 7/1986 |

OTHER PUBLICATIONS

International Search Report mailed on Sep. 27, 2007 for PCT/IN2007/000156.

* cited by examiner

*Primary Examiner*—Anh T Mai
(74) *Attorney, Agent, or Firm*—Lowe Hauptman Ham & Berner, LLP

(57) ABSTRACT

The present invention discloses a bobbin (300) for the secondary winding of the ignition coil of an ignition system an internal combustion engine comprising a tubular core (200) made of electrical grade kraft paper, a plurality of segments (100) also made of electrical grade kraft paper fixed to the core and a coil wound on the core between the plurality of segments. The segments are fixed perpendicularly along the axis of the core. The electrical grade kraft paper is soaked in an electrically insulating material to provide better insulation.

3 Claims, 5 Drawing Sheets

BOBBIN FOR SECONDARY WINDING OF IGNITION COIL

CROSS REFERENCE TO RELATED APPLICATION

This application claims the priority of Indian Patent Application No. 746/CHE/2006, filed on Apr. 24, 2006 in the IPO (Indian Patent Office), the disclosure of which are incorporated herein in their entirety by reference. Further, this application is the National Phase application of International Application No. PCT/IN2007/000156, filed Apr. 23, 2007, which designates the United States and was published in English. Each of these applications is hereby incorporated by reference in their entirety into the present application.

TECHNICAL FIELD

This invention relates to a bobbin for the secondary winding of the ignition coil of the ignition system of an internal combustion engine.

BACKGROUND

Ignition coils are used in internal combustion engines for producing high voltage required for igniting the air-fuel mixture in the engine cylinders through spark plugs.

Generally, an ignition coil has a primary winding, which receives the input from an external source and a secondary winding, which steps up the source voltage, usually of the order of few hundred volts to several kilo volts.

Typically the primary winding consists of 50-300 turns and secondary winding 3000~30,000 turns of insulated conductor depending on the specific requirement. A magnetic circuit core connects the primary winding and secondary winding.

Since the secondary winding has a large number of turns and produces high voltage, usually of the order of 10~60 kilo volts, the winding needs to be adequately insulated, so that a winding at a lower potential does not come into contact with a winding at a potential much higher than the insulation between the two.

The required insulation is generally provided in two steps. In the first step, the windings are segregated or isolated from one another and in the second step; the windings are impregnated under vacuum process to increase the insulation to withstand the high voltage achieved by the winding during operation.

One of the well known types of windings used in industry is where the secondary winding is built segment by segment on a plastic former. Here, the segments are separated by the flanges of the plastic bobbin. Thus the windings are segregated by segments and the insulation is increased by entrapment of insulating material, generally, epoxy or varnish, during the vacuum process used conventionally.

One of the major failure modes associated with the known bobbin winding is caused due to poor adhesion of the insulating material with the plastic material of the bobbin. If the adhesion is poor, which can happen due to vacuum process variations or by long usage, voltage breakdown occurs through the interface between bobbin and winding.

Thus there exists a need for a means to eliminate the failure of the ignition coil caused by the poor adhesion of the insulating material with the plastic bobbin. Further, it is desirable to replace the material of the bobbin to a more suitable insulating material that overcomes all the shortcomings of using plastic as the insulating material.

SUMMARY OF THE INVENTION

This summary is provided to introduce simplified concepts of a bobbin for the secondary winding of the ignition coil of an ignition system of an internal combustion engine which are further described below in the detailed description. This summary is not intended to identify essential features of the claimed subject matter, nor is it intended for use in determining the scope of the claimed subject matter.

According to one aspect of the present invention, a bobbin comprising a core for winding the secondary coil and segments for segregating various loops of the coil has been disclosed. The core of the bobbin as well as the segments is made of kraft paper (electrical grade). The kraft paper is soaked in an electrically insulating material to provide enhanced insulation.

BRIEF DESCRIPTION OF THE DRAWINGS

The novel features of the invention are set forth in the appended claims hereto. The invention itself, however, as well as a preferred mode of use, further objectives, and advantages thereof, will best be understood by reference to the following detailed description of illustrative embodiments when read in conjunction with the accompanying drawings, wherein the same numbers are used throughout the drawings to reference like features, and wherein:

DETAILED DESCRIPTION

A bobbin for the secondary winding of the ignition coil of an ignition system of an internal combustion engine is described in which embodiments are provided for various components and assembly of the bobbin. In one exemplary implementation, assembling of the bobbin is performed by various subsystems. The various assemblies and components are deemed correlated and are associated to each other.

A bobbin for a secondary winding of an ignition coil of an ignition system of an internal combustion engine, disclosed herein comprises a tubular core made of electrical grade paper and a plurality of segments also made of electrical grade paper fixed to the core. The electrical grade paper is soaked in an electrically insulating. The segments are fixed to the core by an adhesive and are perpendicular to the axis of the core. Further, the segment is either donut or semi donut shaped with passage for the coil wound over the core to pass through the segment.

An Exemplary View

Figure 1A:
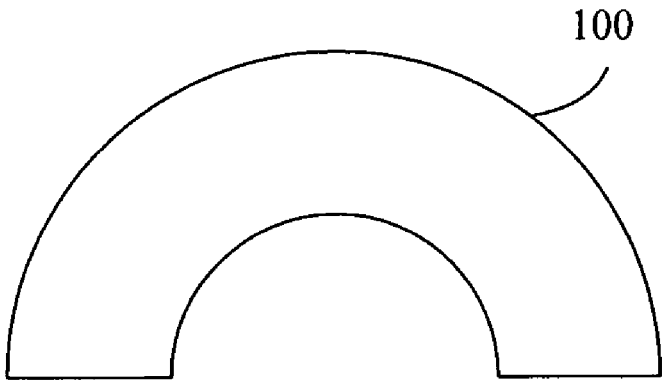
FIGS. 1A and 1B illustrate a view of a segment in accordance with one embodiment of the present invention
Figure 1B:
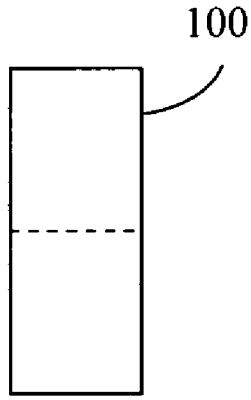

FIGS. 1A and 1B illustrate a view of a segment in accordance with one embodiment of the present invention.

FIG. 1A illustrates a segment 100 shaped as a half donut. FIG. 1B illustrates a side view of the segment 100. The segment 100 is made of electrical grade kraft paper. A pair of segment 100 are placed perpendicular to the axis of the core

200, encircling the core 200 along the circumference and leaving a small gap for a wire to pass through the gap.

A plurality of segment taken in pairs is positioned at small intervals along the entire length of the core 200.

An Exemplary View

Figure 2A:
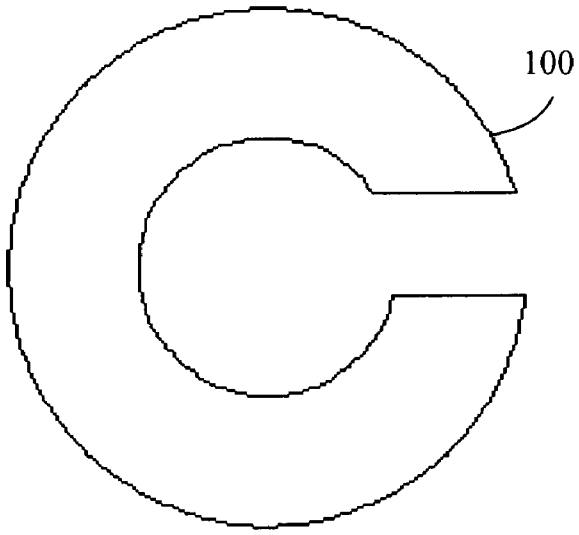
FIGS. 2A and 2B illustrate a view of a segment in accordance with another embodiment of the present invention.
Figure 2B:
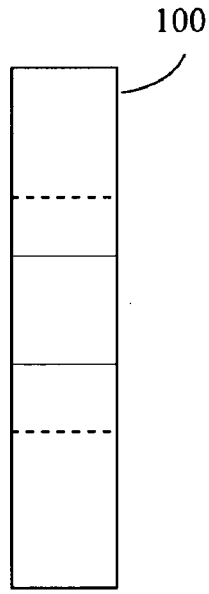

FIGS. 2A and 2B illustrate a separate view of a segment in accordance with another embodiment of the present invention.

FIG. 2A illustrates a segment 100 shaped as a full donut. FIG. 2B illustrates a side view of the segment 100. These segments 100 are placed perpendicular to the axis of the core 200 leaving small spaces in between. The wire or secondary winding of the ignition coil is placed in the spacing between the segments 100. The segments 100 provide insulation, preventing contact between winding of different potential.

An Exemplary View

Figure 3A:
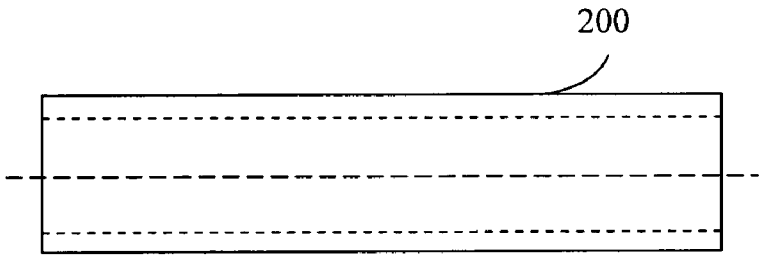
FIGS. 3A and 3B exemplarily illustrates a view of the core.
Figure 3B:
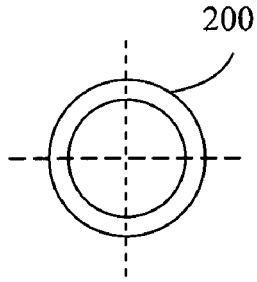

FIGS. 3A and 3B exemplarily illustrate a view of the core 200. The core 200 is generally a tubular structure made of electrical grade kraft paper soaked in insulating material. For example, the core 200 may be a hollow cylinder.

An Exemplary Assembly

Figure 4A:
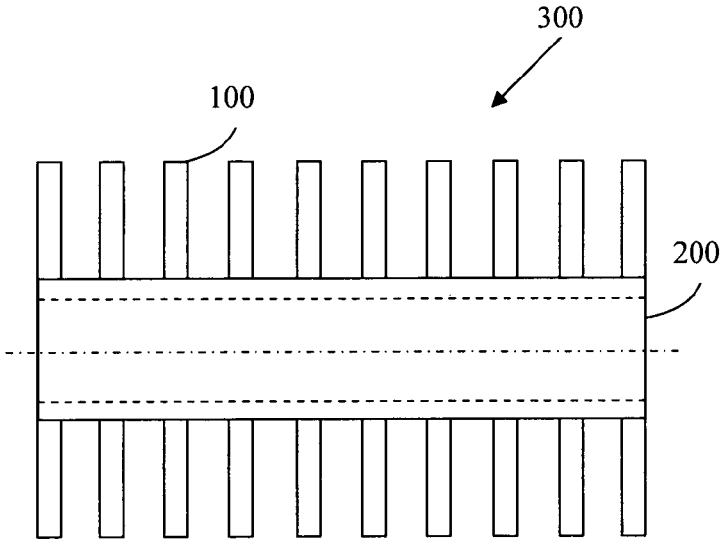
FIGS. 4A and 4B exemplarily illustrates a view of the bobbin with the core and segment assembled to form the complete bobbin assembly.
Figure 4B:
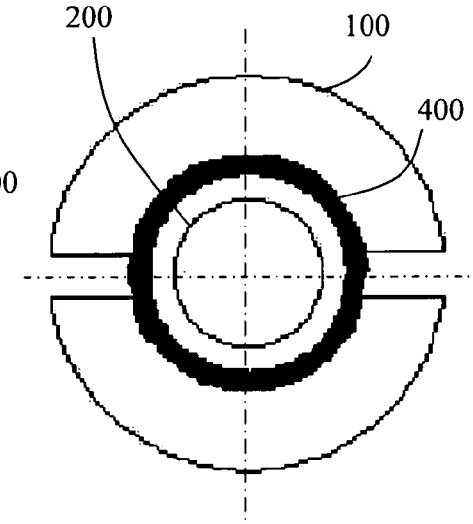

FIGS. 4A and 4B exemplarily illustrates a view of the bobbin 300 with the core 200 and segment 100 assembled to form the complete bobbin assembly. Half donut shaped segment 100 are taken in pairs and fixed at right angles to the axis of the core 200. The segment 200 are fixed to the core 200 with the help of adhesive 400, leaving two diametrically opposite spacing for the coil to pass.

An Exemplary Assembly

Figure 5A:
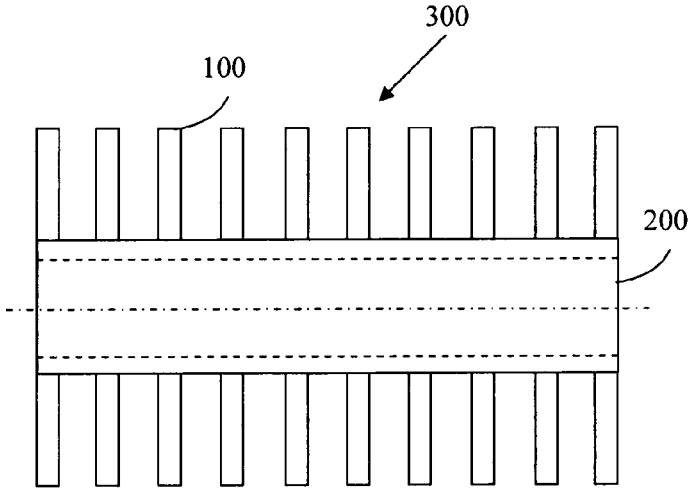
FIGS. 5A and 5B exemplarily illustrates another view of the bobbin with the core and segment assembled to form the complete bobbin assembly.
Figure 5B:
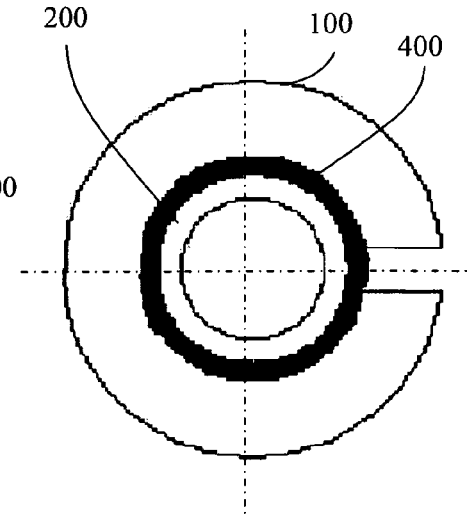

FIGS. 5A and 5B exemplarily illustrates another view of the bobbin 300 with the core 200 and segment 100 assembled to form the complete bobbin assembly. The segment 100 shaped as full donut is fixed at right angle to the axis of the core 200 using an adhesive 400. A small gap is present in the segment for the passage of the coil.

The advantages of the segmented paper bobbin are given below:

a) Voltage breakdown caused by poor adhesive of insulating material with the bobbin is eliminated, thereby enhancing the life of the coil significantly.

b) The number of segments 100 can be determined depending on the specific coil requirement.

c) In case of the known plastic bobbin, since a dedicated mould is required it is difficult to make moulds for each application and therefore for a range of number of turns a common bobbin is used. This puts constraints on optimizing the size of the coil.

d) In the bobbin 300 proposed herein, the number of segment 100 can be arranged based on the requirement of specific number of turns in the secondary winding. Hence the size of the bobbin 300 can be made to suit specific requirement thereby achieving size optimization.

The bobbin for the secondary winding of the ignition coil of an ignition system of an internal combustion engine disclosed herein may be implemented using various other embodiments. The embodiments discussed in this disclosure are provided only for a better understanding of the invention and are not to be considered as limiting.

While the invention has been particularly shown and described with reference to the preferred embodiments thereof, it will be understood by those skilled in the art that various changes in form and detail may be made therein without departing from the spirit and scope of the invention.

We claim:

1. A bobbin for a secondary winding of an ignition coil of an ignition system of an internal combustion engine comprising:

a tubular core made of electrical grade paper;

a plurality of segments made of electrical grade paper fixed to the core, wherein the electrical grade paper is soaked in an electrically insulating medium; and a coil wound on the core between the plurality of segments, wherein each segment of the plurality of segments comprises a pair of semi-donut shaped segments symmetrically placed along the axis of the core, encircling the core, and leaving passages that allow the coil to pass.

2. The bobbin of claim 1, wherein the segment is fixed to the core by an adhesive.

3. The bobbin of claim 1, wherein the segment is fixed perpendicularly along the axis of the core.

* * * * *